US005209716A

United States Patent [19]

Frydman et al.

[11] Patent Number: 5,209,716

[45] Date of Patent: May 11, 1993

[54] RESISTIVE EXERCISE DEVICE

[75] Inventors: Larry G. Frydman, Thornhill; Jerry N. Moscovitch, Toronto, both of Canada

[73] Assignee: Larry Frydman, Ontario, Canada

[21] Appl. No.: 810,474

[22] Filed: Dec. 19, 1991

[51] Int. Cl.[5] ..... A63B 21/02

[52] U.S. Cl. ..... 482/124; 482/121; 482/139

[58] Field of Search ..... 482/121, 122, 123, 900, 482/124, 139, 127, 128; 602/16, 20, 26, 27, 23; 128/25 R

[56] References Cited

U.S. PATENT DOCUMENTS

| | | | |
|---|---|---|---|
| 2,097,376 | 10/1937 | Marshman . | |
| 2,224,103 | 12/1940 | Milson . | |
| 2,855,199 | 10/1958 | Noland et al. | 128/25 R |
| 3,162,441 | 12/1964 | Karlik . | |
| 3,411,500 | 4/1965 | Getts . | |
| 3,814,419 | 6/1974 | Bjorklund et al. | 482/124 |
| 3,929,335 | 12/1975 | Malick | 128/25 R |
| 3,976,057 | 8/1976 | Barclay | 128/25 R |
| 4,033,580 | 7/1977 | Paris . | |
| 4,057,246 | 11/1977 | Wilson . | |
| 4,065,814 | 1/1978 | Fox . | |
| 4,465,276 | 8/1984 | Cox | 482/128 |
| 4,628,910 | 12/1986 | Krukowski | 128/25 R |
| 4,763,901 | 8/1988 | Richter | 128/25 R |
| 4,884,561 | 12/1989 | Letson, Sr. | 602/26 |
| 4,910,802 | 3/1990 | Malloy . | |
| 4,911,439 | 3/1990 | Kahl . | |
| 4,930,767 | 6/1990 | Hamm . | |
| 5,013,037 | 5/1991 | Stermek | 602/16 |
| 5,042,799 | 8/1991 | Stanley | 482/124 |
| 5,052,379 | 10/1991 | Airy et al. | 482/139 |
| 5,116,296 | 5/1992 | Watkins et al. | 482/900 |

*Primary Examiner*—Richard J. Apley
*Assistant Examiner*—Lynne Reichard
*Attorney, Agent, or Firm*—Jordan and Hamburg

[57] ABSTRACT

An exercise device provides resistance to flexion or extension of the arms or legs. The device is worn about the knee or elbow and has a first framework which is secured about the upper portion of the limb and a second framework which is secured about the lower portion of the limb. Struts protrude toward the joint from the upper framework and from the lower framework, and are connected at the joint by a resistive pivot connection. The resistive pivot connection has a resistive mechanism which is attached between the struts by matching projections and conduits which are on opposing faces of the struts and ends of the mechanism. The degree of resistance is varied by substituting a mechanism, which is made of an elastomeric material, with another of different resistive properties. Resistance may be varied by changing the positions of the projections and conduits relative to each other. Moving the relative positions of the conduits and projections would also change the muscle group being exercised. Alternatively, the resistive pivot connection can use a linear resistance such as a shock absorber between the frameworks.

24 Claims, 6 Drawing Sheets

RESISTIVE EXERCISE DEVICE

BACKGROUND OF THE INVENTION

1. Field of the Invention

This invention relates to apparatuses for use in resistive exercise of limbs.

There has been a dramatic rise in people's interest in "wellness" and physical fitness, especially in the past ten years. Health care professionals in general have recommended aerobic activity (ranging from a full high impact aerobic workout to walking) in order to reduce LDL's (certain cholesterol levels), reduce hypertensive states, improve generalized circulation (cardiac function) and improve muscle tone. This trend has led to the development of various exercise devices which provide both aerobic and toning benefits.

It is also evident that in today's lifestyle time is precious and continuing through the 90's productivity will be paramount. Therefore people in general are and will be looking for more time-efficient modes of exercise. This is observed on a daily basis by the rapid rise in sales of home exercise equipment (stationary bikes, rowing machines, and stair machines, for example).

Various resistive exercise devices have been created in the past. They range in complexity from simple limb weights to extravagant elasticized contraptions.

U.S. Pat. No. 2,224,103 to Wilson (1940) and U.S. Pat. No. 4,930,767 to Hamm (1990) disclose elastomeric devices which are affixed to the upper and/or lower limbs for muscular toning by spreading or flexing the limbs. These devices are designed only for a specific type of activity, i.e., abducting the upper and/or lower limbs. They appear to be quite clumsy and difficult to utilize in a combination of maneuvers.

U.S. Pat. No. 4,033,580 to Paris (1977) and U.S. Pat. No. 4,057,246 to Wilson (1977) illustrate a further evolution of elastomeric exercise devices to exercise the upper and lower limbs simultaneously. Once again these devices appear to be designed for a specific regime of exercise for all four limbs at the same time.

U.S. Pat. No. 4,911,439 to Kuhl (1990) displays a body-supported resilient exercise apparatus which is worn on the upper torso. The user dons the device and exercises the upper limbs by forcibly extending the elastic cords in different directions. Although the device exercises the upper limbs, the lower limbs are uninvolved. Also, it appears the device would tend to slip off the user while in use.

U.S. Pat. No. 3,162,441 to Karlik (1964) reveals a universal exercise device which consists of a series of ropes, pulleys and springs which are attached to the user's limbs to be utilized by forcibly moving one limb or more against a resistance mechanism. Again, the device appears to be extremely cumbersome to wear during a range of activities.

U.S. Pat. No. 2,097,376 to Marshman (1937), U.S. Pat. No. 3,411,500 to Gatts (1965), U.S. Pat. No. 4,065,814 to Fox (1978) and U.S. Pat. No. 4,910,802 to Malloy (1990) illustrate several types of exercise clothing devices. With enough tension on the bands in the vertical plane the devices would appear to be uncomfortable to wear on the shoulders and around the waist. Also, as a result of the constant motion of the upper and lower limbs, it would appear that the elasticized straps in the vertical plane would tend to slide laterally off to the side of the muscle.

As described, the above elastomeric devices suffer from one or more of the following disadvantages:

(a) The devices which join one limb to another are exercise-specific and may be difficult to utilize in a combination of exercise procedures without running the risk of tripping and falling.

(b) Attempts to wear separate devices on the upper and lower limbs simultaneously will make the use more complicated and, compounding that with the fatigue factor, could lead to injury.

(c) Exercise suit devices allow the limbs to be actively exercised independently, however, the stresses of the elastomeric components attempting to reach their equilibrium point may lead to discomfort on the shoulders and waist and make the devices uncomfortable to wear for any extended period.

(d) When elastomeric straps are worn across the vertical plane of a joint, the bands may tend to lose their vertical position (slipping off to the side) while the limb is in motion.

(e) A constant source of friction is created when an elastomeric band runs across the vertical plane of a joint. This may lead to further discomfort and possible injury to the user.

(f) Several of these devices appear to be cumbersome to wear and may pose difficulty in maintaining them hygienically.

(g) In this day and age physical fitness is associated with the fashion scene and these devices are bulky and cannot be attractively combined with the latest in fitness attire.

(h) They provide for only a single exercise level unless a major portion of the device is replaced.

BRIEF SUMMARY OF THE INVENTION

In a first aspect the invention provides an exercise device for use on a limb. The device has a first framework for grasping a first part of the limb, a second framework for grasping a second part of the limb, and a resistive pivot connection between the first and second frameworks on one side of the limb which tends to resist pivoting of the frameworks about substantially the same axis as the parts of the limb.

The connection can provide resistance through a range of motion of the parts of the limb about the axis, and may be located on the outside of the limb.

This aspect may further allow variation of the resistance of the connection between motions, and alteration of the neutral resting position of the device. The connection may be a resistive pivot mechanism fixed to each Of the frameworks, which allows pivotal motion about the axis by the frameworks while providing resistance through a range of such motion.

The resistive mechanism may be formed from an elastomeric material to which a retaining plate has been adhered on each end. A plurality of conduits may be radially spaced about the axis and on opposing ends of the mechanism, each framework having struts protruding in the direction of the mechanism, each strut having projections radially spaced about the axis, and the projections of each strut fitting within the conduits on opposing sides of the mechanism, thereby preventing rotational movement between the mechanism and the struts. Alternatively, the conduits may be on the struts, and the projections on the ends of the resistive mechanism.

This aspect may further provide two threaded screws secured to and projecting from either end of the mechanism, and orifices at the ends of the struts, the screws and orifices being substantially co-axial with the axis, and a pair of nuts, one affixed to each of the screws on either side of the mechanism holding the struts and mechanism, together. It may further allow at least one set of conduits and projections to be axially rotated with respect to one another to alter the neutral resting position of the device.

In addition, the resistive level of the exercise device may be varied by replacing the mechanism with another mechanism of a different resistive level. Furthermore, the mechanism can be substantially cylindrical and co-axial with the axis, and the conduits can be on either end of the mechanism, with the mechanism enclosed by a cylindrical casing between the struts.

Alternatively, the first and second framework may be connected by a linear resistance such as a shock absorber, which provides resistance away from the junction point of the two frameworks during pivoting.

Each framework may have a releasable fastener to allow attachment of the framework to the limb and release from the limb. The releasable fastener may be an adjustable clasp strap fastener for relatively fine adjustment of the framework about the limb.

Each framework may possess a variable hinge to allow for relatively gross adjustment of the framework about the limb. This variable hinge may have a tongue on one sub-framework of each framework and two or more grooves on the other sub-framework of each framework, the variable hinge being formed by inserting the tongue in one of two grooves. Alternatively, the variable hinge may be a hinge set having one part on one of the sub-frameworks and two or more matching parts on the opposing sub-framework, the variable hinge being formed by fitting the first part of the hinge set into one of the matching parts, and securing with a central pin.

Each framework may be formed from a lightweight material such as polypropylene, aluminum, or another suitable alternative. The frameworks can be lined at the points where they contact the limb in order to reduce chafing. The lining may be a foam material such as neoprene.

In a second aspect, the invention provides a mechanism for use in an exercise device, the mechanism being a substantially Cylindrical piece of elastomeric material providing resistance when its ends are rotated in opposing directions, the piece having a retaining plate adhered to each end, and several conduits on each of its ends radially spaced apart from the axis of the cylinder. This aspect may further provide a threaded screw secured to and protruding from each end of the mechanism, such that the screws are substantially co-axial with the mechanism, and the conduits are radially spaced on each end of the mechanism out from the screws.

In a third aspect, the invention provides a mechanism for use in an exercise device, the mechanism being a substantially cylindrical piece of elastomeric material providing resistance when its ends are rotated in opposing directions, the piece having a retaining plate adhered to each end and, several projections on each of its ends radially spaced apart from the axis of the cylinder. This aspect may further provide opposing threaded screws, one secured to and protruding from each end of the mechanism, such that the screws are substantially co-axial with the mechanism, and the projections are radially spaced on each end of the mechanism about the screws.

It is an object of the present invention to satisfy one or more of the following:

(a) To provide a resistive exercise device which can exercise one limb independently of the others and thus allow the user to perform multi-tasked exercising;

(b) To provide resistive exercise devices that can be worn on both the upper and lower limbs simultaneously, thus reducing the time necessary for a full body workout;

(c) To provide resistive exercise devices that can be worn on both the upper and lower limbs simultaneously without increasing the complexity of use, and while also reducing the risk of injury as a result of fatigue;

(d) To provide resistive exercise devices which can exercise each limb independently without increasing inferior tension on both the shoulders and waist which would tend to create discomfort;

(e) To provide resistive exercise devices where any elastomeric components are able to maintain their vertical plane without creating a torsional effect around the joint while in motion;

(f) To provide a resistive exercise device where contact between moving components and the skin surface is lessened, thus reducing the possibility of irritation or injury;

(g) To provide a resistive exercise device which may be easily fitted to the body and cleaned and maintained with limited effort; and (h) To provide a resistive exercise device that can be worn over or concealed under regular fitness attire.

BRIEF DESCRIPTION OF THE DRAWINGS

For a better understanding of the present invention and to show more clearly how it may be carried into effect, reference will now be made, by way of example, to the accompanying drawings which show the preferred embodiment of the present invention and in which.

DETAILED DESCRIPTION OF THE PREFERRED EMBODIMENTS

In this description when reference is made to part of a limb it means that portion of a limb which is substantially contiguous with another portion of the limb and is connected to the other other portion about a pivot axis substantially perpendicular to both portions through a range of motion. For example, the first portion could be the upper arm, the second could be the forearm, and the axis would be through the elbow joint.

Figure 1:
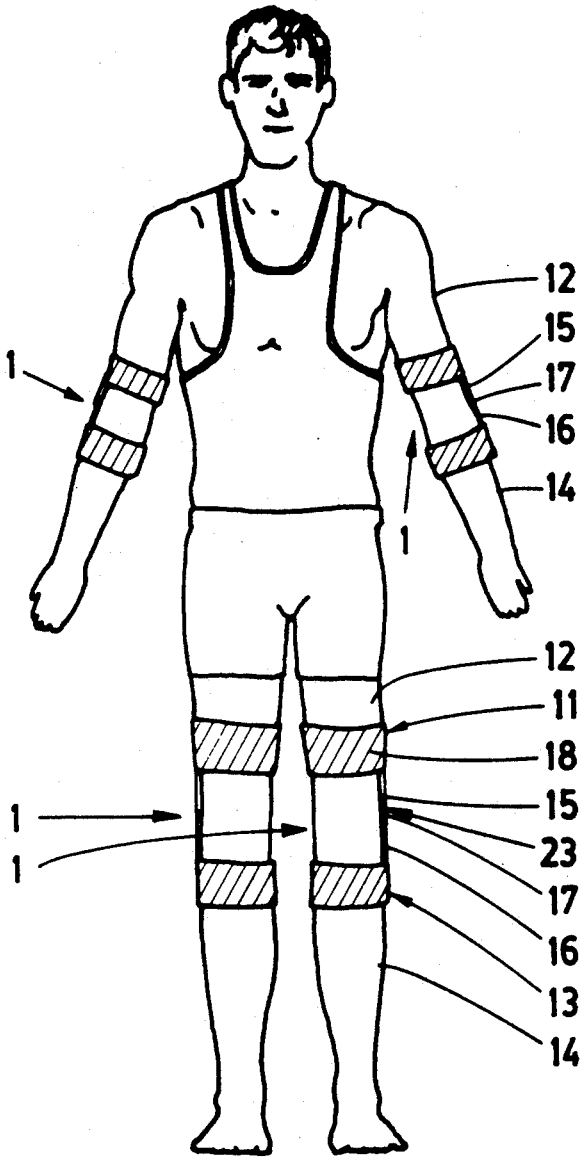
FIG. 1 is a front view of a person wearing four exercise devices according to the preferred embodiment of the present invention.
Figure 2:
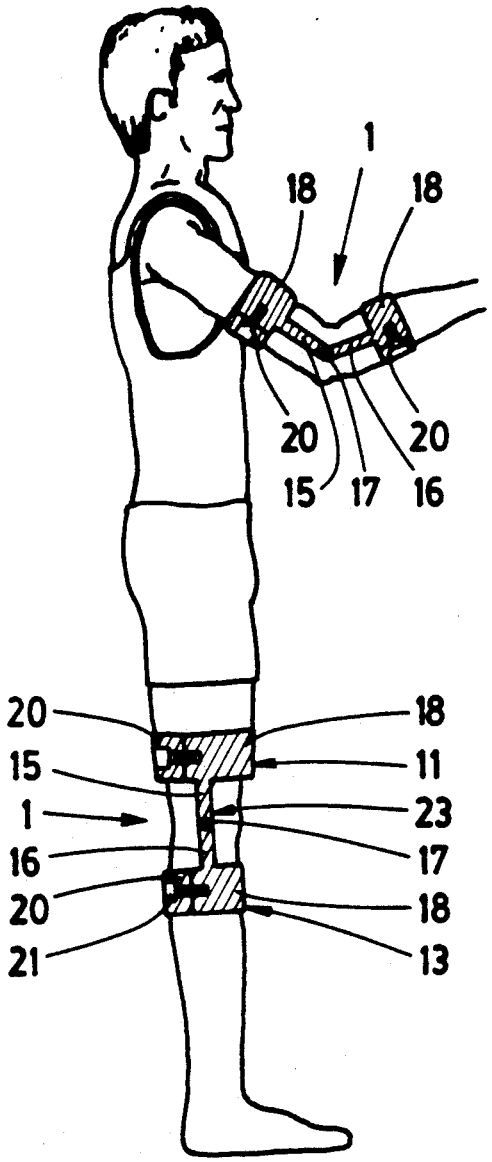
FIG. 2 is a side view of a person wearing the exercise devices of FIG. 1.
Figure 3:
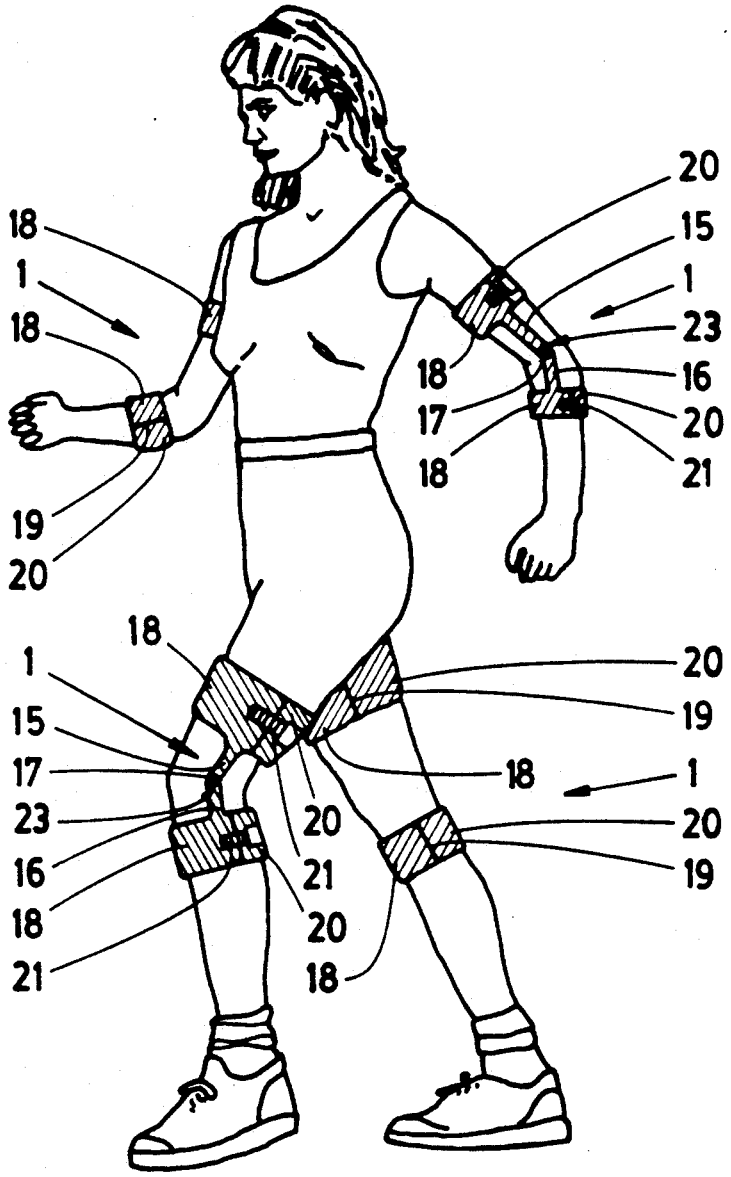
FIG. 3 is perspective view of a person wearing the exercise devices of FIG. 1 during physical activity.

Referring to the drawings in which similar reference characters denote similar elements throughout the several views, FIGS. 1, 2 and 3 illustrate four exercise devices 1, one worn on each of the elbow and knee joints. The devices 1 worn on the elbow joints may be smaller than those on the knee joints. The device 1 for a left joint can be formed in the mirror image of a device 1 for a right joint.

Each exercise device 1 has a superior framework 11 which attaches to a proximal part 12 of the limb and an inferior framework 13 which attaches to a distal part 14 of the limb.

The frameworks 11, 13 may be injection moulded out of a polypropylene plastic material, which is light in weight and quite durable. The use of plastic allows that part of the exercise device 1 to be cleaned easily by wiping with a damp cloth. As will be evident to those skilled in the art, other materials, such as aluminum, could be used with similar results.

The frameworks 11, 13 may possess perforations or cut-outs, not shown, to provide increased ventilation and thereby reduce perspiration.

The superior framework 11 has an inferiorly projecting strut 15 and the inferior framework 13 has a superiorly projecting strut 16. The struts 15, 16 are pivotally connected at a junction point 17. It is advantageous to place struts 15, 16 on only the outer side of the limb to avoid contact between the device 1 and the body, another limb, or another device. However, struts, not shown, may be placed on the inner side for additional stability. The struts may be ribbed, not shown, for increased strength.

Figure 4:
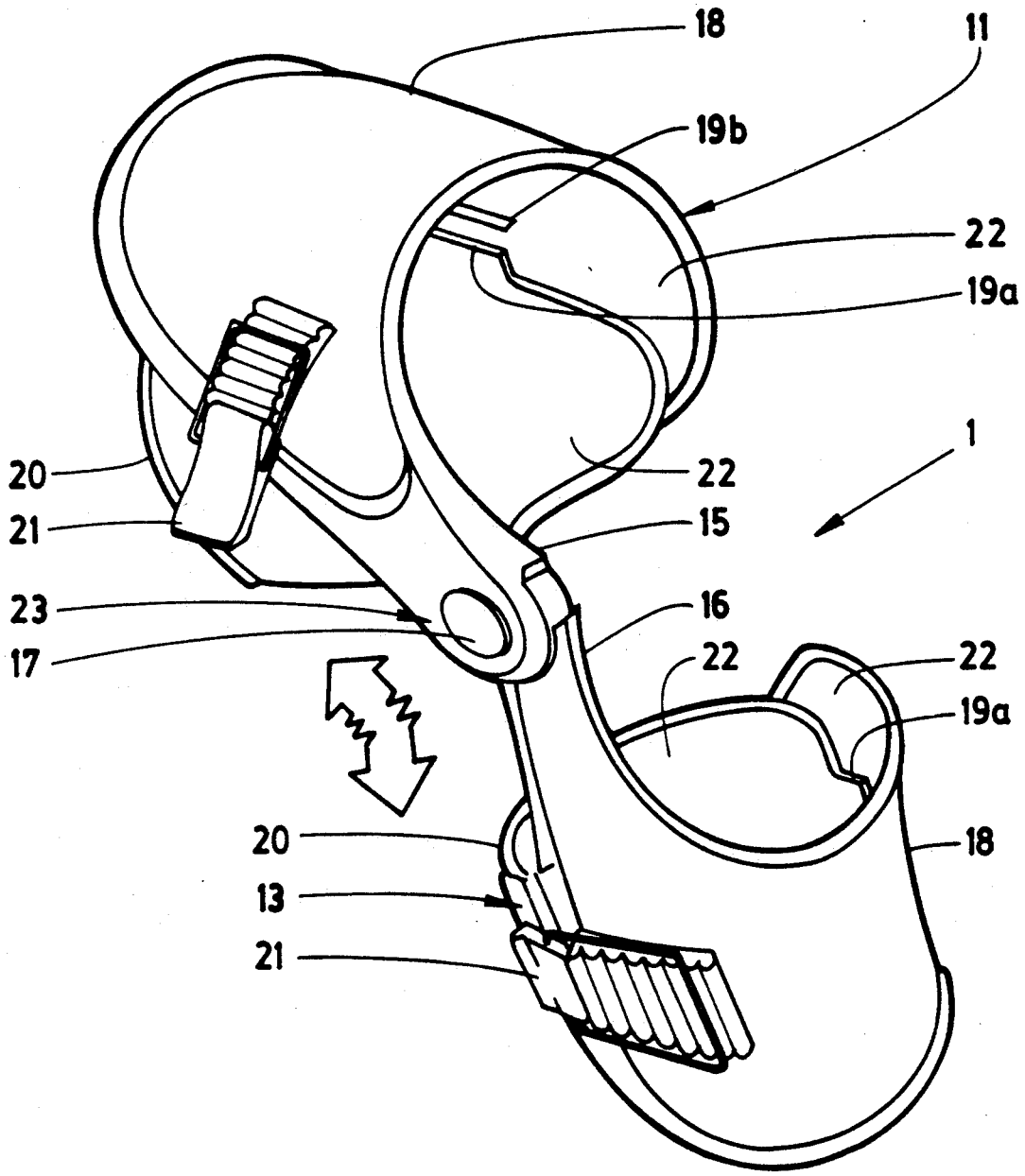
FIG. 4 is an enlarged perspective view of one of the exercise devices of FIG. 1.
Figure 5:
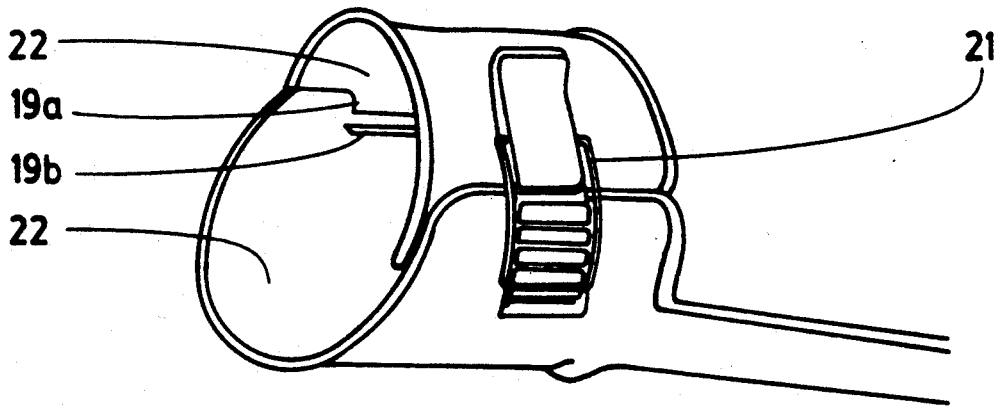
FIG. 5 is a perspective view of a framework of one of the exercise devices of FIG. 1 in a clasped position.
Figure 6:
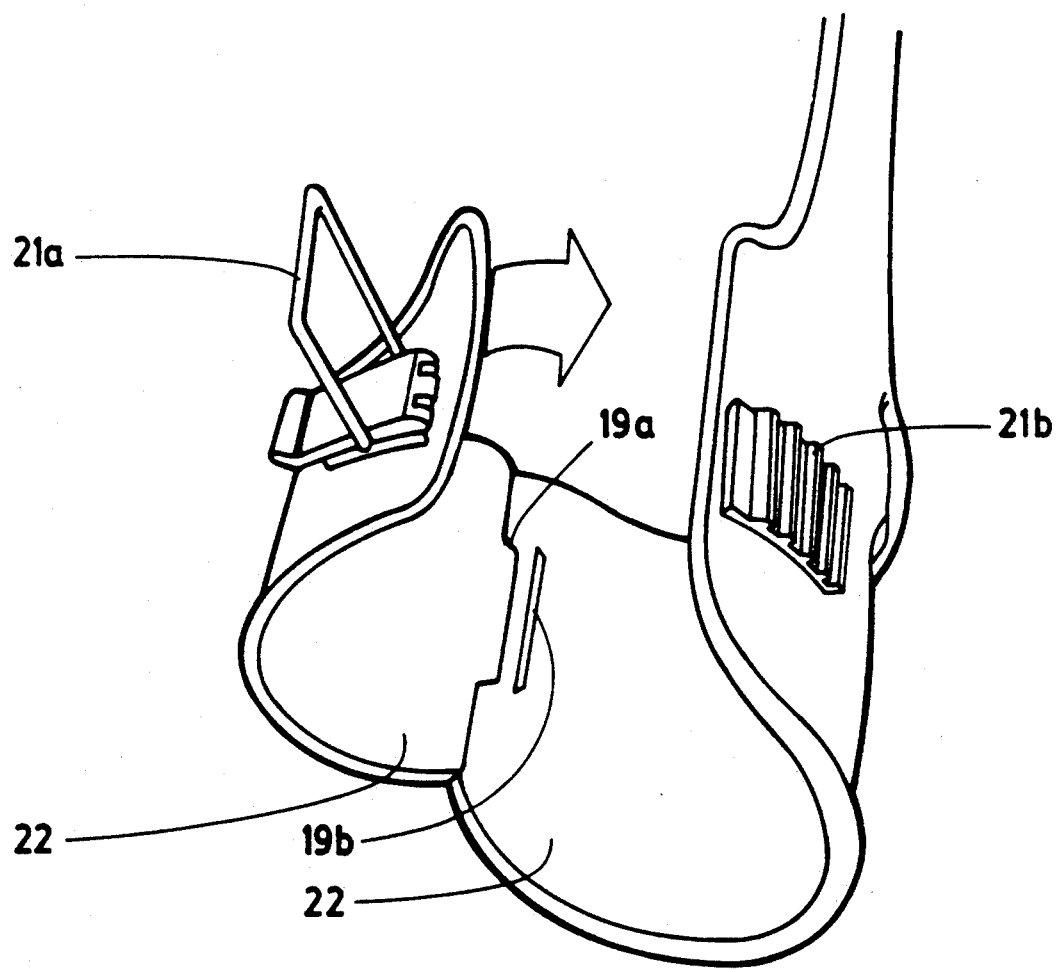
FIG. 6 is a perspective view of the framework of FIG. 5 in an unclasped position.

Referring to FIGS. 4, 5 and 6, the superior framework 11 and inferior framework 13 each have an anterior sub-framework 18 and posterior sub-framework 20. The anterior subframework 18 and posterior subframework 20 are affixed on the inner side of the limb via a variable hinge 19 for gross adjustibility for limb girth. On the outer side of the limb the anterior subframework 18 and posterior sub-framework 20 are affixed via an adjustable clasp strap fastener 21, such as might be used as a ski boot buckle, for fine adjustment to limb girth. The buckle 21*a* of the clasp strap fastener 21 is on the posterior sub-framework 20 of each framework 11 or 13, and a strap 21*b* with several evenly spaced slots is on the anterior sub-framework 18. A portion of the buckle 21*a* is placed in the slot 21*b* giving the best fit depending on limb girth, and the fastener is secured.

The variable hinge 19 has a tongue 19*a* on one subframework 20 and at least two grooves 19*b* on the other sub-framework 18. The tongue 19*a* is positioned in one of the grooves 19*b* depending on the girth of the limb, which provides a fairly snug but not uncomfortable fit. Although shown in the figures, it may be difficult to see the groove 19*b* into which the tongue 19*a* has already been inserted.

In another embodiment, the variable hinge 19 may be a standard type of hinge set similar to that on a door frame, not shown, in which one part of the hinge set is formed on one sub-framework, and the other part of the hinge set is formed on the other sub-framework in two or more locations. The part of the hinge set on the first sub-framework is fitted with the other part of the hinge set on the second sub-framework giving the closest loose fit to the limb, and the hinge set is secured by insertion of a central pin.

Once the variable hinge 19 adjustment has been performed for the initial setup, it is only necessary to open and close the clasp strap fastener 21, to either don or remove the device 1. In donning the device 1 for the lower limb, the clasp fastener on the inferior framework 23 should be adjusted so that this framework 13 is secured above the point where the calf reaches its maximum girth and will not slide downward.

Due to the highly adaptive nature of the hinge 19 and fastener 21, the device 1 can be contoured to fit limbs of varying sizes.

The inner border of the superior and inferior frameworks 11, 13 is covered with a slip-resistant lining material 22. The lining 22 can be a foam material such as neoprene which also cushions the device against the limb.

Figure 7:
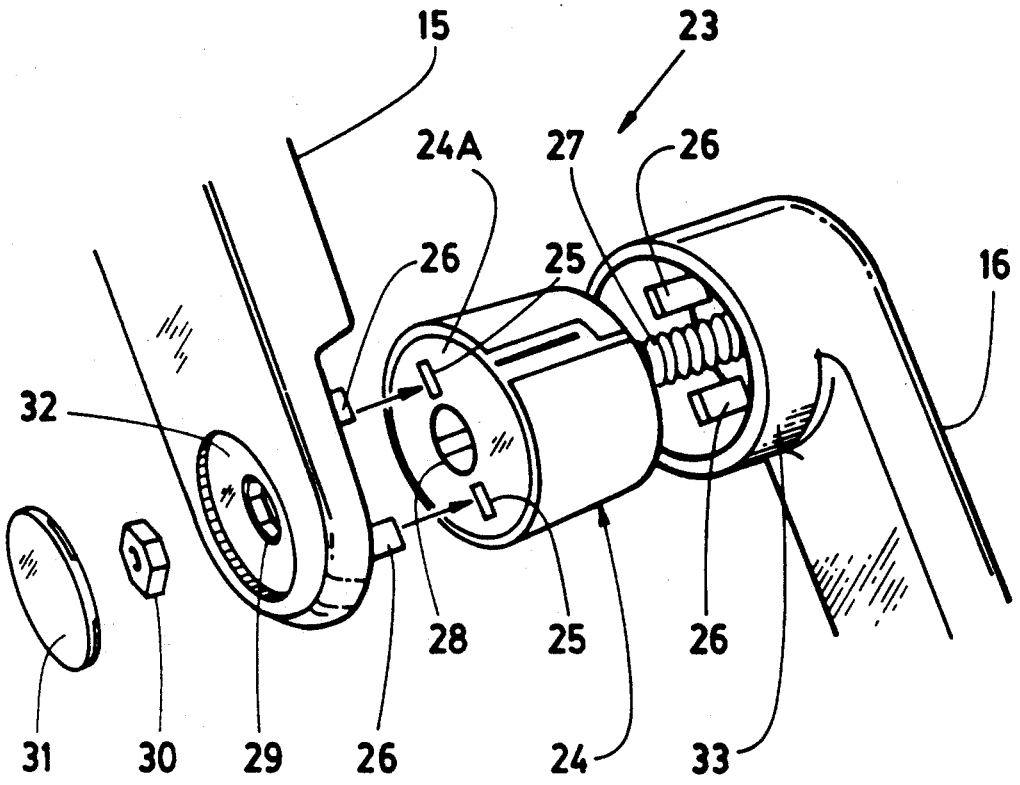
FIG. 7 is an exploded perspective view of a resistive connection employed in the device of FIG. 1.
Figure 8:
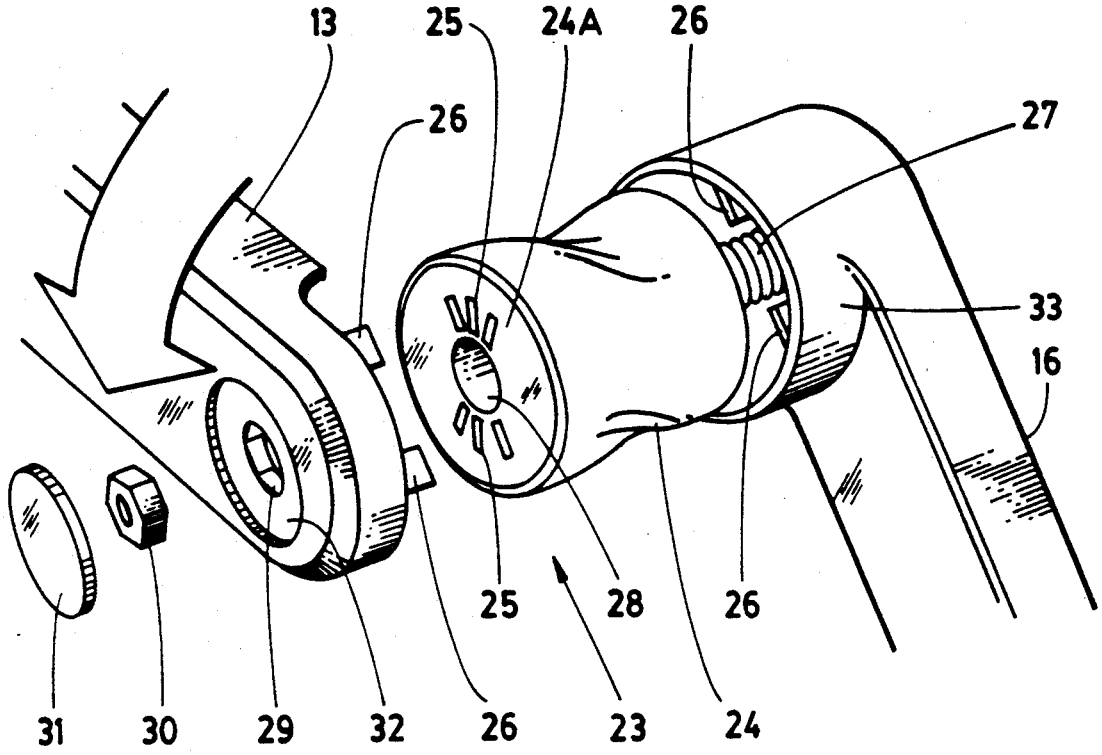
FIG. 8 is a perspective view of the resistive connection from FIG. 7 illustrating its action.

As seen in FIGS. 7 and 8, the inferior projecting strut 15 and superior projecting strut 16 are connected at the junction point 17 by a resistive pivot connection 23. In this description the resistive pivot connection 23 provides a force which tends to resist an applied force about the junction point 17 such as would occur when flexing or extending a limb.

The connection 23 may have a resistive mechanism 24 with a retaining plate 24A, adhered to each end. The mechanism 24 has a pair of female conduits 25 on each of its inner and outer aspects through the retaining plate 24A which receive a pair of male projections 26 protruding from the opposing surfaces of the interiorly projecting strut 15 and the superiorly projecting strut 16. As the figures are drawn in perspective, two of the female conduits 25 are not shown.

As shown in FIG. 8 a plurality of pairs of female conduits 25 may be provided about the mechanism 24 to allow for alteration of the neutral resting position of the device 1.

Secured to the retaining plate 24A on each end of the resistive mechanism 24 is a threaded screw 27. In FIGS. 7 and 8 only one such screw 27 is shown. The pairs of female conduits 25 on each face of the mechanism 24 are substantially aligned radially from the center 28 of the mechanism 24 from which the screw 27 protrudes and lie at approximately 180 degrees from one another.

Each threaded screw 27 passes through a respective orifice 29 at the distal end of the interiorly projecting strut 15 and superiorly projecting strut 16 and the connection 23 is fastened by machine nuts 30 threaded onto the screws 27 where they project through the orifices 29. For aesthetic purposes and to prevent access to the interior of the connection 23, a nut cap 31 fits in a beveled recess 32 along the distal outer aspect of the interiorly projecting strut 15 and along the distal inner aspect of the superiorly projecting strut 16.

The resistive mechanism 24 apart from the plate 24A may be fabricated from an elastomeric substance having acceptable resistive properties for the purposes described herein. The plate 24A should be formed from a material which can be properly secured to the rest of the resistive mechanism 24 and the screws 27, and resist tearing of the conduits 25 by the projections 26. Metal would be suitable.

A cylindrical casing 33 projects from strut 16 and meets strut 15 to enclose the mechanism 24.

As illustrated the mechanism 24 may be compact and fit neatly within the exercise device 1, eliminating the need for bulky and clumsy springs, bands or tubing.

The exercise device 1 may be compact enough to be concealed under regular clothing.

Referring to FIG. 3, in operation the exercise device 1 is worn about the elbow or knee joint and provides resistance to flexing or extending actions of the limbs about these joints. As the exercise device 1 has a number of adjustments for limb size, the device 1 may be used for both upper and lower limbs. Alternatively, a smaller version may be constructed for the upper limbs, and a larger version for the lower limbs. As mentioned previously, the struts 15, 16 are best placed on the outer side of the limb. Thus the exercise device 1 for a limb on one side of the body could be a mirror image of the device 1 for the limb on the other side.

The neutral resting position of the exercise device 1 is that point where the mechanism 24 bears no tension. This neutral resting position can be altered by rotating the female conduits 25 on one end of the resistive mechanism 24 relative to those on the other end or relative to the projections 26, or some combination thereof as shown in FIG. 8.

An external lever, not shown, between one strut 15 or 16 and the resistive mechanism 24 might also be added which could retract the projections 26 to allow the neutral resting position to be altered. This would allow the neutral resting position to be altered without taking the device apart.

By altering the neutral resting position, the individual can change the group of muscles being resisted and exercised. Initially with the mechanism 24 at a resting state of 0 degrees (i.e., the exercise device 1 is extended so that it can lie flat), the hamstring and biceps muscle of the lower and upper limbs respectively will be resisted while attempting to reach 135 degrees of maximal flexion. If the resting state of the mechanism 24 is altered to 45 degrees, then extension of the knee and elbow provides resistance applied to the quadriceps and triceps, respectively, while attempting to move the joint towards full extension (0 degrees). Altering the neutral resting position may also change the degree of resistance for a given position of the exercise device 1.

The degree of resistance may also be varied by replacing the mechanism 21 with a mechanism 24 providing a different amount of resistance. If the portion of the mechanism 24 excluding the retaining plates 24A on the ends is made from rubber or a similar substance the resistance may be varied by changing the density of the substance. This can provide an overall conditioning workout program.

The mechanism 24 can be easily altered (changing resistive action) or quickly replaced.

The device 1 can reduce the time necessary to perform regular aerobic activity. When worn on a regular basis, the device 1 can enhance muscle toning while going about a normal daily routine.

The degree of physical work performed is related to the amount of resistance provided by the exercise device 1, the duration of work performed, the degree of movement of the limb and the velocity of movement.

It will be understood that this description is made with reference to the preferred embodiment. However, it is possible to make other embodiments employing the principles of the invention and which fall within its spirit and scope as defined by the following claims. For instance, another embodiment might include a resistive pivot connection 23 with a linear resistance provided away from the junction point 17, such as a shock absorber which connects the superior 11 and inferior 13 frameworks, while the junction point provides little or no resistance. Embodiments may also be constructed to exercise other body parts, for example, ones for use on finger joints.

We claim

1. An exercise device for use on a limb having a first part, a second part and a joint therebetween, the joint having a pivot axis, the exercise device comprising:

a first framework for grasping the first part of the limb;

a second framework for grasping the second part of the limb;

a single resistive tension pivot connection between the first and second frameworks on one side of the limb which tends to resist pivoting of the frameworks about substantially the same axis as the joint, the resistive tension pivot connection having a neutral resting position and being disposed intermediate between the two frameworks along the axis, and the resistance being provided at the axis of the joint by a tension mechanism;

wherein the neutral resting position can be set; and wherein resistance is provided in both directions of movement of the joint from the neutral resting position.

2. The exercise device of claim 1, wherein the connection provides resistance through a range of motion of the parts of the limb about the axis.

3. The exercise device of claim 2, wherein the connection is on the outside of the limb.

4. The exercise device of claim 3, wherein the resistance of the connection can be varied between motions.

5. The exercise device of claim 4, wherein the neutral resting position can be altered.

6. The exercise device of claim 3, wherein the connection comprises a resistive pivot mechanism fixed to each of the frameworks, which allows pivotal motion about the axis by the frameworks while providing resistance through a range of such motion.

7. The exercise device of claim 6, wherein the resistive mechanism is formed from an elastomeric material.

8. The exercise device of claim 7, wherein the resistive pivot mechanism comprises a plurality of conduits radially spaced about the axis and on opposing ends of the mechanism, each framework comprises struts protruding in the direction of the mechanism, each strut has projections radially spaced about the axis, and wherein the projections of each strut fit within the conduits on opposing sides of the mechanism and are fixed thereby from rotational movement between the mechanism and the struts.

9. The exercise device of claim 8, wherein the mechanism further comprises two threaded screws secured to and projecting from either end of the mechanism, the struts further comprise distal orifices, and the connection further comprises a pair of nuts, the screws and orifices being substantially co-axial with the axis, and a nut of the pair being affixed to each of the screws on either side of the mechanism to fix the struts and mechanism together.

10. The exercise device of claim 9, wherein at least one set of conduits and projections can be axially rotated with respect to one another to alter the neutral resting position of the device.

11. The exercise device of claim 10, wherein the resistive level of the exercise device may be varied by replacing the mechanism with another mechanism of a different resistive level.

12. The exercise device of claim 9, wherein the mechanism is substantially cylindrical and co-axial with the axis, the conduits are on either end of the mechanism, and the connection further comprises a substantially cylindrical casing between the struts which encloses the mechanism.

13. The exercise device of claim 12 wherein the mechanism further comprises a retaining plate on either end to which the threaded screws are secured and through which the conduits are formed.

14. The exercise device of claim 3, wherein each framework comprises a releasable fastener to allow attachment of the framework to the limb and release from the limb.

15. The exercise device of claim 14, wherein the releasable fastener comprises an adjustable clasp strap fastener for relatively fine adjustment of the framework about the limb.

16. The exercise device of claim 15, wherein each framework comprises a variable hinge to allow for relatively gross adjustment of the framework about the limb.

17. The exercise device of claim 16, wherein the variable hinge comprises a tongue on a first sub-framework of each framework and a plurality of grooves on a second sub-framework of each framework, the variable hinge being formed by inserting the tongue in one of the grooves.

18. The exercise device of claim 16, wherein the variable hinge comprises a hinge set having one part on one of the sub-frameworks and a plurality of the matching parts on the opposing sub-framework, the variable hinge being formed by fitting the first part of the hinge set into one of the matching parts, and securing with a central pin.

19. The exercise device of claim 3, wherein each framework is primarily formed from a plastic material.

20. The exercise device of claim 19, wherein the plastic material is polypropylene.

21. The exercise device of claim 3, wherein each framework is primarily formed from aluminum.

22. The exercise device of claim 19, wherein the plastic material is lined where the framework contacts the limb.

23. The exercise device of claim 22, wherein the lining is formed from a foam material.

24. The exercise device of claim 23, wherein the foam material is neoprene.

* * * * *